US006525697B1

(12) United States Patent
Theobold

(10) Patent No.: US 6,525,697 B1
(45) Date of Patent: Feb. 25, 2003

(54) ARCHIMEDES SPIRAL ARRAY ANTENNA

(75) Inventor: David Theobold, Akron, OH (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 09/947,620

(22) Filed: Sep. 6, 2001

Related U.S. Application Data

(63) Continuation of application No. 09/903,471, filed on Jul. 11, 2001, now abandoned.

(51) Int. Cl.[7] ..... H01Q 1/36

(52) U.S. Cl. ..... 343/895; 343/700 MS; 343/795

(58) Field of Search ..... 343/700 MS, 792.5, 343/795, 895; H01Q 1/36, 1/38

(56) References Cited

U.S. PATENT DOCUMENTS

| | | | | | |
|---|---|---|---|---|---|
| 3,745,585 | A | * | 7/1973 | Barbano | 343/792.5 |
| 4,697,192 | A | * | 9/1987 | Hofer et al. | 343/895 |
| 5,257,032 | A | * | 10/1993 | Diamond et al. | 343/730 |
| 5,331,453 | A | * | 7/1994 | Lipsky | 343/895 |
| 6,219,006 | B1 | * | 4/2001 | Budish | 343/895 |

* cited by examiner

*Primary Examiner*—Tho Phan
(74) *Attorney, Agent, or Firm*—Arter & Hadden LLP; Larry B. Donovan

(57) ABSTRACT

A two-dimensional array design for an aperiodic array antenna. The design utilizes monopole or similar antenna elements that are arranged into the topology of an Archimedes spiral. The preferred spacing between radial arcs of the spiral is approximately one-half the desired wavelength. The preferred spacing between elements is also approximately one-half the desired wavelength

21 Claims, 3 Drawing Sheets

20

Array Element Placement

ARCHIMEDES SPIRAL ARRAY ANTENNA

CROSS-REFERENCE TO RELATED APPLICATIONS

This is a continuation of application Ser. No. 09/903,471 filed on Jul. 11, 2001 now abandoned.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION (1) Field of the Invention

This invention relates generally to antennas, and more specifically, to antennas comprised of arrayed elements having nominally omnidirectional patterns in two dimensions.

(2) Description of the Related Art Including Information Disclosed Under 37 CFR 1.97 and 37 CFR 1.98.

Array antennas are employed in diverse application areas, including direction finding, null forming, space division multiple access, multipath canceling, and mapping. The elements of the array are chosen based upon element gain and coverage, either two-dimensional or three-dimensional.

An array antenna may be comprised of a plurality of monopole antennas or monopole-like elements. A monopole antenna is an antenna consisting of a straight conducting rod, wire, or other structure oriented nominally perpendicular to a ground plane and fed near the junction of the structure and the ground plane. The class of monopole antennas in general also includes short dipoles and vertically polarized patch antennas. As is well known in the art, the radiation pattern of the monopole antenna is two dimensional, transverse to the longitudinal axis of the monopole, with the peak normal to the axis of the monopole. The coverage area of the antenna is approximately uniform in the horizontal plane. By utilizing an array of monopole antennas, a uniform controlled coverage is obtainable, having a steerable pattern function, and gain that is dependent upon the number of elements and control implementation. Antennas comprised of arrayed elements having nominally omnidirectional patterns in two dimensions are designed to optimize one or more of the following characteristics: peak gain, high front-to-back ratio, low omnidirectional ripple in gain, uniform sidelobe and backlobe level, and high packing ratio with circular symmetry. These characteristics may be optimized to varying degree by using classical array topologies of the prior art. These array topologies include square lattices, hexagonal lattices, and random arrays, among others. However, square and hexagonal lattices are constrained to a fixed number of antenna elements. Random arrays are difficult to manufacture since the element locations are not defined by deterministic functions. Thus, the need exists for an array antenna that exhibits high gain, high front-to-back ratio, low gain ripple, good sidelobe and backlobe characteristics, and high packing ratio while at the same time being easily manufactured having an arbitrary number of elements.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of instrumentalities and combinations particularly pointed out in the appended claims.

BRIEF SUMMARY OF THE INVENTION

In view of the aforementioned needs, the invention contemplates an Archimedes spiral array antenna comprised of an arbitrary number of arrayed elements having nominally omnidirectional patterns in two dimensions spaced at a fixed fraction of wavelengths apart on the spiral, with the first element located at or near the center of the spiral and adjacent arcs of the spiral located at a fixed fraction of wavelengths apart.

The topology of this configuration is unique from three standpoints. First, the element-to-element spacing, location of the first element, and arc-to-arc distances are arbitrary. Second, the array exhibits aperiodic differential phase characteristics across its aperture in two dimensions, independent of the number of elements. Third, the locations of the array elements are easy to define.

The arc-to-arc spacing distances, location of the first element, and element-to-element spacing are arbitrary, providing three degrees of freedom for the control of grating lobe and backlobe characteristics. The defining equation of the spiral, $R=kA$, employs k to control the spacing between adjacent arcs of the spiral, where R is the radial measure and A is the angular measure in a circular coordinate system. The first element is located at initial position $(R_0,A_0)$. The element-to-element spacing is $d=|(R_n,A_n)-(R_{n-1},A_{n-1})|$, the Euclidean distance between adjacent elements, for all elements $n=\{0, 1, \ldots, m-1\}$, and m total elements. These three parameters control array area, packing ratio, sidelobe levels, and gain ripple. Both k and d are generally chosen so that elements and spiral arms are on the order of one-half wavelength apart; the first element is generally at or near the origin of the spiral.

The Archimedes spiral array can be designed to exhibit aperiodic differential phase characteristics across its aperture in two dimensions, independent of the number of elements. This characteristic forms the basis of its excellent backlobe performance, in particular for a relatively small number of elements, for example eight or more. Because the number of elements is arbitrary, the Archimedes spiral array antenna is ideally suited to applications where the system architecture requires a specified number of elements. Conversely, conventional arrays defined by periodic grids require a specific number of elements to fill the periodic grid and are hence constrained to those numbers.

The locations of the elements for an Archimedes spiral antenna are easy to define, contributing to ease of manufacturing. The simplicity of defining locations is due to the fact that the defining equation is a deterministic function. The antenna array of the present invention displays the same desirable performance characteristics as a random array but has a higher packing density and is easy to manufacture.

The antenna array of the present invention is easily distinguished from prior art spiral antennas. The typical prior art spiral antenna is a logarithmic spiral. The prior art spiral antenna is usually etched or attached to a substrate. The prior art spiral antenna designs do not have monopole elements, and consequently are not arrays, and the field is nominally perpendicular to the plane of the spiral.

In contrast, the present invention is directed to an array antenna with a plurality of monopole or similar elements arranged along an Archimedes spiral topology. The monopole elements are extending away from the plane of the spiral. The electric fields are parallel to the monopole elements (not the plane of the spiral), the peak gain patterns of which are normal to the axis of the spiral elements.

While the present invention has been described in a preferred embodiment utilizing monopole elements, those skilled in the art should readily appreciate that other arrayed elements having nominally omnidirectional patterns in two dimensions such as dipoles or patch antennas are also suitable.

Among those benefits and improvements that have been disclosed, other objects and advantages of this invention will become apparent from the following description taken in conjunction with the accompanying drawings. The drawings constitute a part of this is specification and include exemplary embodiments of the present invention and illustrate various objects and features thereof.

BRIEF DESCRIPTION OF THE SEVERAL VIEWS OF THE DRAWING

The drawings illustrate the best mode presently contemplated of carrying out the invention.

This the drawings.

DETAILED DESCRIPTION OF INVENTION

Figure 1:
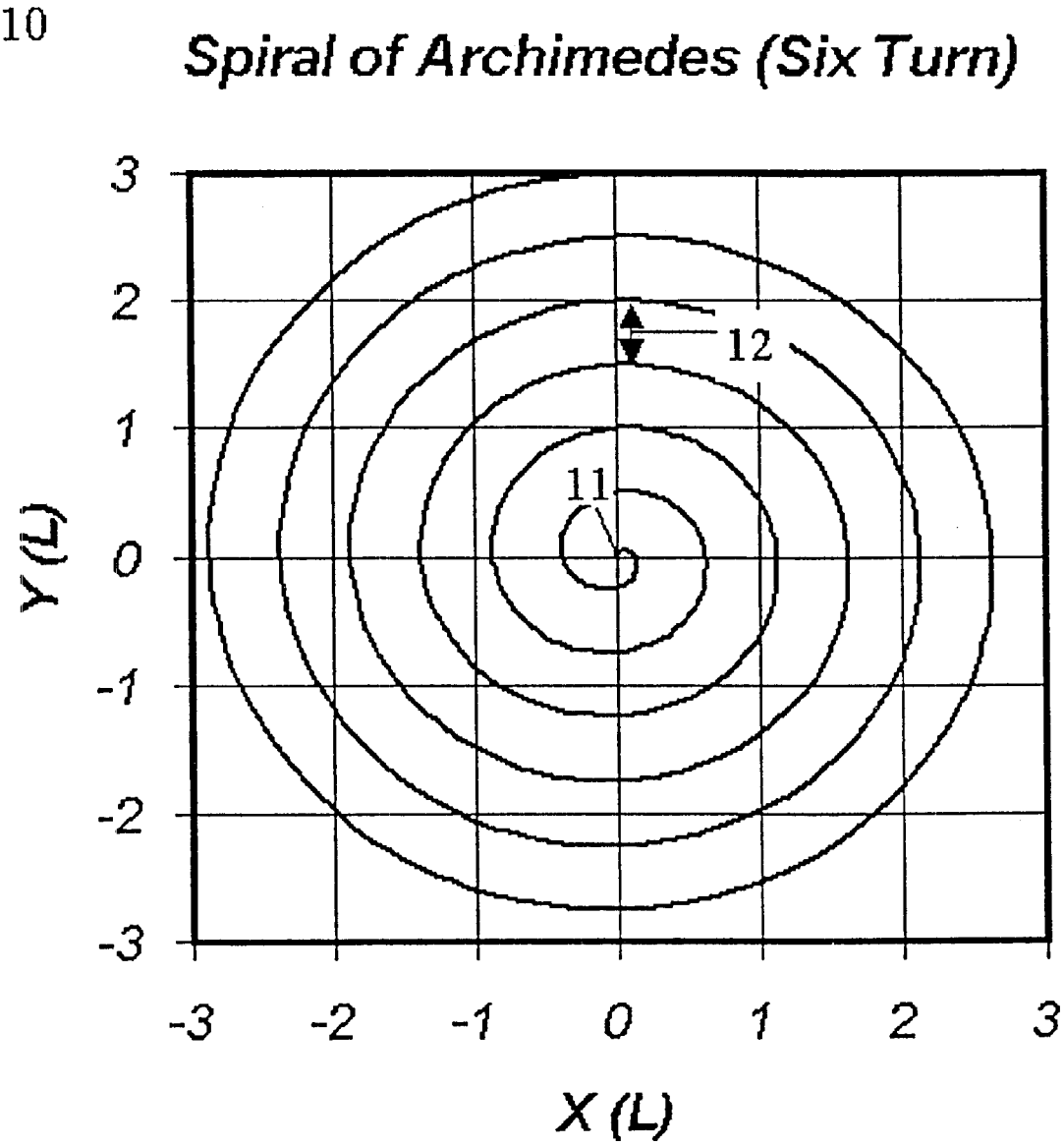
FIG. 1 is a representation of a spiral of Archimedes.

Array antennas are employed in diverse application areas. The elements of an array antenna are chosen based upon element gain and coverage, either two-dimensional or three-dimensional. Topology selection, however, is based upon required sidelobe level, grating lobe performance, required array gain, phase ripple, cross coupling, beam coverage and steering, symmetry, electronic complexity, size, weight, and power. Topology is typically the clear design driver for arrays.

One-dimensional array topology design is a straightforward process. The array is either periodic or aperiodic. A periodic array is filled at equal intervals along a line or circle. The aperiodic array, sometimes called "thinned", is utilized in order to optimize certain performance requirements, such as sidelobe level, mainbeam gain or complexity.

Two-dimensional array design is more complex. One-dimensional topologies can be extended to periodic circular layouts or square periodic or aperiodic designs in two-dimensional space, but these designs are often less than satisfactory. Some of the problems associated with one-dimensional topologies extended into two-dimensional space include the fact that the number of elements is not arbitrary (that is, the elements must fill in the design space), that packing is usually not optimal and hence off-axis grating lobes must be carefully. tracked, and that asymmetries often arise in off-axis directions.

Once a suitable array element has been selected, a topology must be found that meets the aforementioned design requirements. Although interrelated, the design requirements can be condensed into a few heuristic, but entirely measurable, rules.

First, elements should be spaced on the order of one-half wavelength apart and no further. Greater spacing leads to the emergence of grating lobes. Closer spacing exacerbates coupling effects.

Second, all elements should be packed as closely as possible in two-dimensional space. This maximizes gain, eliminates wasted physical area, and keeps feed lines short and losses low.

Third, maintain circular symmetry as much as possible if there is no preference in directional gain. Departing from symmetry complicates steering and may raise sidelobe levels as well.

Fourth, avoid phase periodicity in any circular symmetry. Periodicity leads to higher sidelobes and unacceptable gain ripple as a function of frequency.

The classical approach to following these guidelines has been to use a topology that is derived from a uniform random distribution in the X-Y plane over a circular area. Studied and implemented via holes in plates, gratings, or multiple feeds, this approach results in superb main beam formation, low sidelobes, and good symmetry performance. For an example of this approach see: Y. T. Lo, Antenna Handbook, Volume II, Antenna Theory, Van Nostrand Reinhold, New York (1993). A shortcoming of this approach is that for small arrays, such as arrays with a few dozen or fewer elements, the designer is limited to low gain for a relatively small number of elements as well as compromised performance in 2-D space.

The present invention proposes an array topology following a simple Archimedes spiral. A spiral is a plane curve that, in general, unwinds around a point while moving ever farther from the point. Many types of spirals are known, the first dating from the days of ancient Greece. The curves are observed in nature.

The Greek mathematician Archimedes defined the spiral that bears his name. The equation of the Spiral of Archimedes is R=kA, in which R is the length of the radius measured from the origin of a circular coordinate system; A is the angular position (the total amount of rotation) relative to the beginning of the spiral; and k is a constant defined by the change in R per spiral turn. One property of the spiral is that the arm contours of the spiral are a constant distance apart. FIG. 1 is an example of a six turn Spiral of Archimedes. The spiral, generally designated 10 is defined by the equation R=kA. The origin of the spiral is designated 11 and the spiral proceeds outward in a clockwise direction. The distance between the arcs 12 is constant for every arc. The depiction of 10 exhibits an X-Y coordinate system, with six spiral turns. The distance between arcs 12 can be varied by modifying the value of the constant k; in the case of 10, k=0.5 per spiral turn. When defining the Spiral of Archimedes for antenna arrays, k is generally defined with units of wavelengths (L) per spiral turn.

The defining equation for the present invention is R=kA, where k controls the spacing between adjacent arcs of the spiral, where R is the radial measure in a circular coordinate system and A is the angular measure. The first element is located at position $(R_0,A_0)$. The element-to-element spacing is $d=|(R_n,A_n)-(R_{n-1},A_{n-1})|$, for all elements n={0, 1, . . . , m}, for an m-element array. Both k and d are generally chosen so that elements and spiral arms are on the order of one-half wavelength apart; the first element is generally at or near the origin of the spiral.

The topology of the present invention is unique from three standpoints. First, the element-to-element spacing, position of the first element, and arc-to-arc spacing are arbitrary and provide three degrees of freedom for the control of the grating lobe and backlobe characterstics. The element-to-element spacing is controlled by d, and k controls the arc-to-arc spacing. By varying k and d, the array area, packing ratio, sidelobe levels and gain ripple can be altered. Both k and d are generally chosen so that the elements and spiral arms are on the order of one-half wavelength apart. The second unique characteristic is that the array exhibits aperiodic differential phase characteristics across its aperture in two dimensions, independent of the number of elements. This characteristic forms the basis of the present invention's excellent backlobe performance, particularly for a small number of elements, such as eight or more. Because the number of elements is arbitrary, the present invention is ideally suited to applications where the system architecture requires a specified number of elements. The third unique characteristic of the present invention is that the locations of the elements are easy to define. This contributes to ease of manufacturing. The simplicity of defining locations is due to the fact that the defining equation is a deterministic function.

Figure 2:
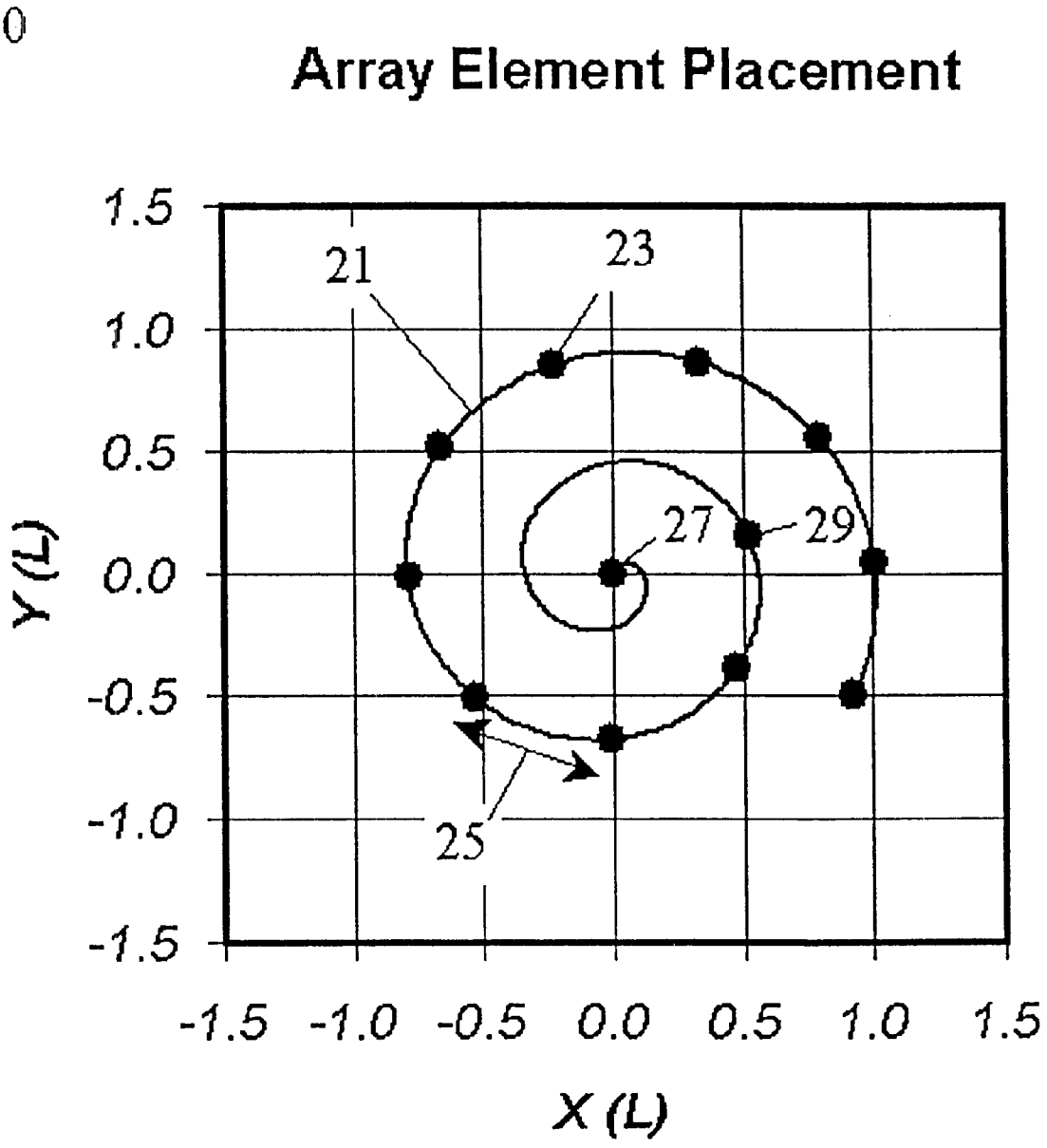
FIG. 2 is a two dimensional view of an example of the present invention where twelve monopole elements are desired.

FIG. 2 is an example of the present invention. In this example, twelve elements are plotted. The X and Y axes are a function of wavelength, L. The array element placement is generally designated 20. A Spiral of Archemedes 21 is plotted; the locations for the elements are generally labeled 23. The distance between elements is labeled 25 and is controlled by the variable d in the defining equation. The first point 27 is located at the origin in this example. The second point 29 is located a distance d from the first point. As can be seen by this example, the distance between elements 27 and 29 is on the order of one-half a wavelength (specifically, 0.54 wavelength for the example). Furthermore, distance between the arms of the spiral, controlled by the variable k, is also on the order of one-half wavelength (specifically, 0.45 wavelength for the example).

The method for placing the elements in FIG. 2 is as follows. The first element 27 is placed at the origin. The angular rotation A is then increased until the Euclidean distance to the previous point is a fixed fraction of the wavelength, namely 0.54 for the example. The process is then continued until the desired number of elements is reached.

Figure 3:
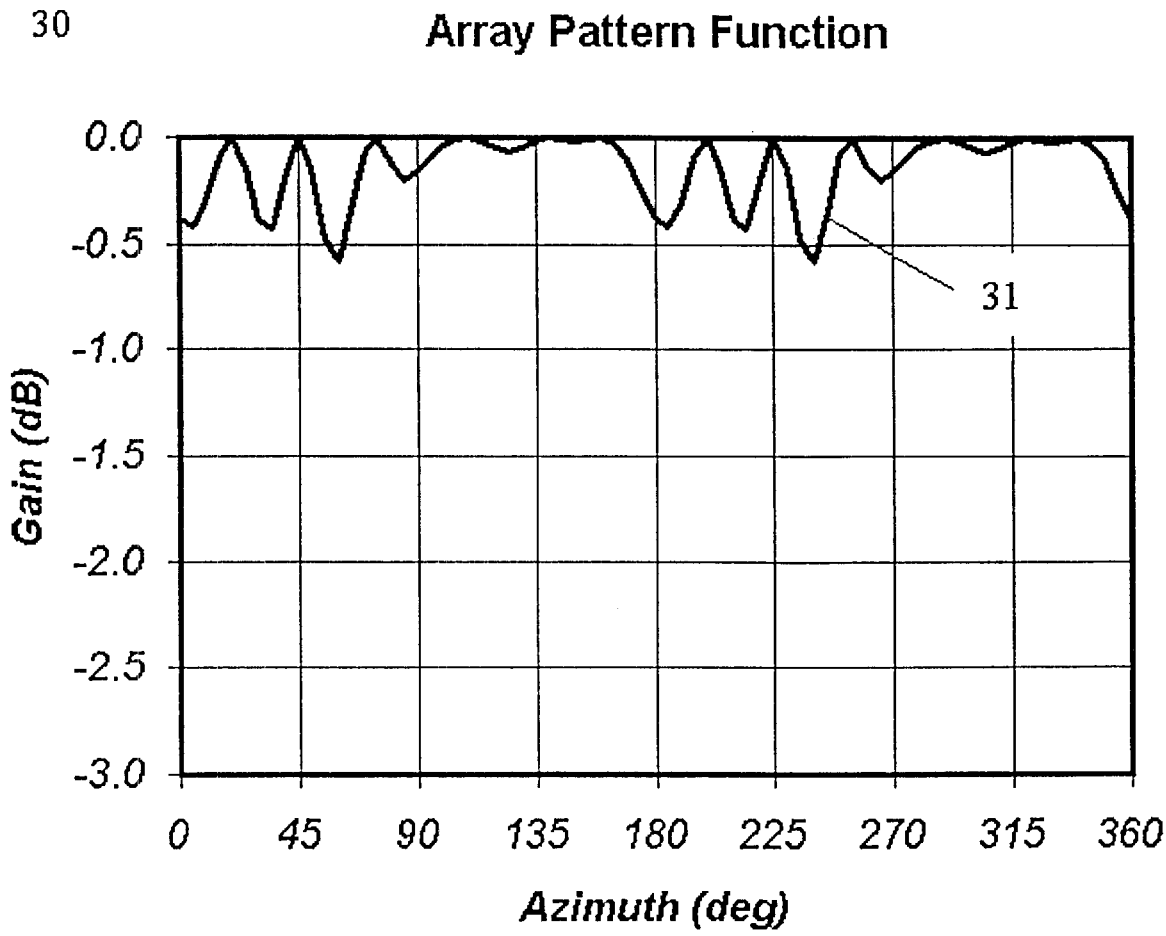
FIG. 3 is a plot of gain vs. azimuth angle where the number of monopole elements is twelve.

A less obvious characteristic is that there is little phase symmetry in the X-Y plane. Hence, it is expected that there should be low phase or gain ripple as a function of azimuth. FIG. 3 shows the array pattern function 31 as a function of azimuth angle. The plot is generally designated 30 and shows the array pattern function for an array antenna having twelve elements. The average peak-to-peak ripple is on the order of 0.5 dB. Hence, the array will have superb performance when used as a beam steering or null steering device.

The distances for the fraction of a wavelength for k and d are typically on the order of one-half a wavelength. However, as those skilled in the art can readily appreciate, depending on the desired frequency, external factors, and the fact that a truly isotropic antenna cannot be realized exactly in practice, the values of k and d may need to be slightly adjusted. It is expected in the typical case the adjustment factors for k and d would be less then ten percent, and in a worse case scenario twenty percent. Thus even after the adjustment, the values of k and d are still substantially one-half a wavelength.

Although the invention has been shown and described with respect to a certain preferred embodiment, it is obvious that equivalent alterations and modifications will occur to others skilled in the art upon the reading and understanding of this specification. The present invention includes all such equivalent alterations and modifications and is limited only by the scope of the following claims.

What is claimed is:

1. An array antenna comprising a plurality of individually controlled radiating arrayed elements having nominally omnidirectional patterns in two dimensions, the elements suitably spaced with respect to one another and arranged along the path of an Archimedes spiral;

wherein the relative phase and amplitude of signals applied to each of the elements are controlled to obtain the desired radiation pattern from the combined action of all the elements.

2. The antenna of claim 1, wherein a first of the arrayed element is located at the center of the spiral.

3. The antenna of claim 1, wherein the distance between arcs is a fixed fraction of a wavelength on the order of one-half the wavelength.

4. The antenna of claim 3, wherein the distance between arrayed elements is a fixed fraction of a wavelength on the order of substantially one-half the wavelength.

5. The antenna of claim 1, wherein the distance between arrayed elements is a fixed fraction of a wavelength on the order of one-half the wavelength.

6. The antenna of claim 1, wherein the longitudinal axes of the arrayed elements are normal to a plane of the spiral.

7. The antenna of claim 1, wherein a conductor is connected to the end of the arrayed element that intersects a plane of the spiral.

8. The antenna of claim 1, wherein the arrayed element is a monopole.

9. The antenna of claim 1, wherein the arrayed element is a dipole.

10. The antenna of claim 1, wherein the arrayed element is a substantially omni-directional patch element.

11. The antenna of claim 1, wherein the spiral is defined by the equation R=kA, where k controls the spacing between adjacent arcs of the spiral, where R is the radial measure and A is the angular measure in a circular coordinate system; the first element is located at position $(R_0,A_0)$; the element-to-element spacing is $d=|(R_n,A_n)-(R_{n-1},A_{n-1})|$, for all elements $n=\{0, 1, \ldots, m-1\}$, for an m-element array.

12. The antenna of claim 11, wherein the longitudinal axis of the arrayed elements is normal to the plane of the spiral.

13. The antenna of claim 11, wherein the distance between arcs is a fixed fraction of a wavelength on the order of one-half the wavelength.

14. The antenna of claim 11, wherein the distance between arrayed elements is a fixed fraction of a wavelength on the order of one-half the wavelength.

15. An array antenna comprising a plurality of individually controlled radiating monopole elements, the elements suitably spaced with respect to one another and arranged along the path of an Archimedes spiral on a two dimensional planer surface, wherein the spiral is defined by the equation R=kA, where k controls the spacing between adjacent arcs of the spiral, where R is the radial measure and A is the angular measure in a circular coordinate system; a first element is located at position $(R_0,A_0)$;

wherein the element-to-element spacing is $d=|(R_n,A_n)-(R_{n-1},A_{n-1})|$, for all elements $n=\{0, 1, \ldots, m-1\}$, for an m-element array, and the values for k and d are on the order of one-half a wavelength; a feed for each element is located at the intersection of the element with the two-dimensional planer surface; and wherein the relative phase and amplitude of signals applied to each of the elements are controlled to obtain the desired radiation pattern from the combined action of all the elements.

16. The array antenna of claim 15 wherein the m is at least six.

17. A method of making an array antenna, the method comprising the steps of:

(a) selecting the parameters for an Archimedes spiral;

(b) plotting the Archimedes spiral on a planer surface;

(c) selecting a quantity of individually controlled radiating arrayed elements having nominally omnidirectional patterns in two dimensions;

(d) plotting coordinates comprising the location of where the arrayed elements are to be mounted on the spiral, a first element being located at the center of the spiral and the elements being suitably spaced with respect to one another; and (e) attaching each arrayed element so that one end of the element is attached to the planer surface at the plotted location;

wherein the relative phase and amplitude of signals applied to each of the elements are controlled to obtain the desired radiation pattern from the combined action of all the elements.

18. The method of claim 17, the selecting the parameters step further comprising spacing the arcs of the spiral a fixed fraction of a wavelength.

19. The method of claim 17, the plotting step further comprising spacing the arrayed elements a fixed fraction of a wavelength.

20. The method of claim 17, wherein fixed fraction of a wavelength for the arcs of the spiral is on the order of one-half the wavelength.

21. The method of claim 17, wherein fixed fraction of a wavelength for spacing the arrayed elements is on the order of one-half the wavelength.

* * * * *